United States Patent [19]

Erickson

[11] 4,044,597

[45] Aug. 30, 1977

[54] FREQUENCY TUNING SYSTEM WITH VISUAL DISPLAY

[75] Inventor: Bruce G. Erickson, Santa Clara, Calif.

[73] Assignee: American Microsystems, Inc., Santa Clara, Calif.

[21] Appl. No.: 723,035

[22] Filed: Sept. 13, 1976

Related U.S. Application Data

[62] Division of Ser. No. 578,606, May 19, 1975, Pat. No. 4,024,750.

[51] Int. Cl.[2] ..... G04D 7/12

[52] U.S. Cl. ..... 73/6; 324/79 R; 324/82

[58] Field of Search ..... 73/6; 324/79, 82

[56] References Cited

U.S. PATENT DOCUMENTS 1,818,787 8/1931 Bowman et al. ..... 324/78 R

FOREIGN PATENT DOCUMENTS 496,666 12/1938 United Kingdom ..... 73/6

*Primary Examiner*—S. Clement Swisher

*Attorney, Agent, or Firm*—Owen, Wickersham & Erickson

[57] ABSTRACT

A visual tuning-aid system for aligning an electronic timepiece to a correct reference frequency is disclosed. A reference oscillator in the system provides a reference signal at a precisely fixed predetermined frequency which is, or is converted to, the correct alignment frequency for the timepiece. A sensor electrostatically detects a time base signal in the timepiece and a band-pass amplifier removes any extraneous signals. The reference signal and the time base signal are provided to a phase shift indicating device of a multiphase motor in the system which provides a visual display, the movement of which is proportional to the rate of phase change between the reference signal and the time base signal. Alignment of the timepiece to the correct frequency stops the phase change and thereupon the visual display stops moving.

3 Claims, 3 Drawing Figures

FREQUENCY TUNING SYSTEM WITH VISUAL DISPLAY

This is a division, of application Ser. No. 578,606 filed May 19, 1975 now U.S. Pat. No. 4,024,750

BACKGROUND OF THE INVENTION

The present invention relates to an electronic visual display test apparatus, and more particularly it relates to a test instrument providing a visual motion display which becomes stationary when the frequency of an electronic timepiece is adjusted to coincide with a calibration frequency generated within the apparatus.

Electronic timepieces, particularly digital-display electronic watches, utilize either continuous or intermittent digital time displays driven by a time signal. This signal is derived by frequency divider circuits driven from a timebase signal generator controlled by a quartz crystal. The crystal frequency may be at any one of a number of frequencies. Typically, frequencies utilized by watch designers are selected to coincide with an integral power of the base two. For instance, one commonly used frequency is 32,768 hertz (or $2^{15}$ hz) and another is 4,194,304 hertz (or $2^{22}$ hz). The selection of a time base frequency must take into account two factors: one, the universal time period for all timepieces is one second, and two, crystal tolerances are best controlled in a range from about $2^{15}$ to $2^{22}$hz.

Certain crystalline materials when subjected to the influence of an electric field, tend to vibrate at a periodic rate, commonly known as the resonant frequency. These vibrations have long been used in crystal oscillator circuits to control the frequency of the oscillator because the crystal presents a very low impedance feedback path to the oscillator at precisely its resonant frequency. The intrinsic resonant frequency of a crystal typically varies slightly from crystal to crystal because of a number of factors which cannot be completely controlled such as physical size. However, the resonant frequency of any crystal can be made to vary slightly by addition and subtraction of capacitance. Consequently, electronic timepieces using time-base crystal oscillators routinely provide a small trimmer capacitor to enable tuning of the crystal to a precise desired frequency which can be used to control circuitry to drive an accurate time display. The present invention provides a visual tuning-aid that makes possible a rapid and precise alignment of the trimmer capacitor of an electronic timepiece, such as a digital wristwatch.

Heretofore, adjustment of the trimmer capacitor was accomplished primarily with a precision digital frequency counter capable of displaying at least five and sometimes many more digits of different numbers representing the frequency or period of the time-base signal generator of a timepiece to be aligned. Use of those frequency counters, especially in production line situation resulted in eyestrain and undue operator fatigue. Impermissable calibration errors naturally resulted. In addition, each digital frequency counter tended to be very expensive because of the substantial costs of precision master oscillators which were required and contained in each such counter. In addition, reading the required digits of such a counter caused the operator to spend a substantial amount of time for each timepiece undergoing calibration. Thus, production rates were slow becasue of delays at the calibration station, a drawback only overcome by increasing the number of such stations. These and other disadvantages are overcome by the present invention.

In use, electronic timepieces from time to time require readjustment of the frequency generator element. Typically, such recalibration is required after the timepiece is dropped or otherwise jarred or subjected to severe mechanical shock. Such shock tends to realign the quartz crystal or causes it to vibrate at a slightly different resonant frequency which has thereby necessitated recalibration. Thus, in addition to an initial precise calibration, the trimmer capacitor provides a recalibration mechanism for setting the crystal oscillator of electronic timepieces from time to time as the need arises. It is consequently important that the trimmer capacitor provide a sufficient tuning range on both sides of the precisely desired frequency so that subsequent adjustments can be performed either up or down as may be required in a particular timepiece. Heretofore, as with the initial calibration of the trimmer, its recalibration was also accomplished with a digital counter having drawbacks already mentioned. This problem is also overcome by the present invention.

With greatly increased production and use of electronic timepieces having trimmer capacitors for precise calibration, a need arose for a simple, inexpensive and reliable calibration tool that field repair stations and jewelers can utilize for field recalibration of electronic timepieces. Heretofore, no simple test apparatus was available to field stations and jewelers. Again, the apparatus of the present invention fills that need.

In view of the foregoing, it is an object of the present invention to provide a simple visual indication system enabling rapid, precise calibration of electronic timepieces to a correct frequency as well as determination of the tuning range of such timepieces.

Another object of the present invention is to provide a tuning-aid system for electronic timepieces in which an unmistakable moving visual display ceases to move when the timepiece is adjusted precisely to the correct frequency.

Yet another object of the present invention is to provide a simple and inexpensive visual tuning-aid test instrument for use by electronic timepiece service stations and jewlers for field calibration of electronic timepieces to a correct frequency.

BRIEF SUMMARY OF THE INVENTION

The foregoing and other objects are accomplished by a visual tuning-aid system for calibrating electronic timepieces to a correct frequency which includes a reference oscillator, a sensor adapted to pick up and amplify a time based signal from a timepiece to be calibrated, and a display device. The reference oscillator may operate at a predetermined frequency which is the same as, or integrally related to, the correct frequency for the timepiece.

In the preferred embodiments of the present invention, signals derived from the reference oscillator are combined with signals derived from the sensed time-base signal generator of a timepiece to be aligned. The combined signals are used to drive the display device in a way which provides a movement display, such as a spot moving in a circular path, or a rotating indicator needle, indicative of the rate of change of phase of the timepiece signal generator relative the signal from the reference oscillator when the timepiece generator frequency is above or below the correct frequency. When the generator frequency is tuned to the correct reference frequency, phase shift therebetween ceases and the display stops movement indicating precise alignment of the timepiece.

In one embodiment of the present invention phase shifted reference signals and phase shifted sensed signals are simultaneously applied to small three phase motor driving an indicator needle wherein integration of the rate of change of the signals causes the motor to rotate the indicator needle until the sensed signal from the timepiece is adjusted to coincide with the reference signal whereupon the motor ceases to rotate the needle and the indicator becomes stationary.

Other objects, advantages and features of the invention will become apparent from the following detailed description of the embodiments presented in conjunction with the accompanying drawings.

DESCRIPTION OF PREFERRED EMBODIMENTS

Figure 1:
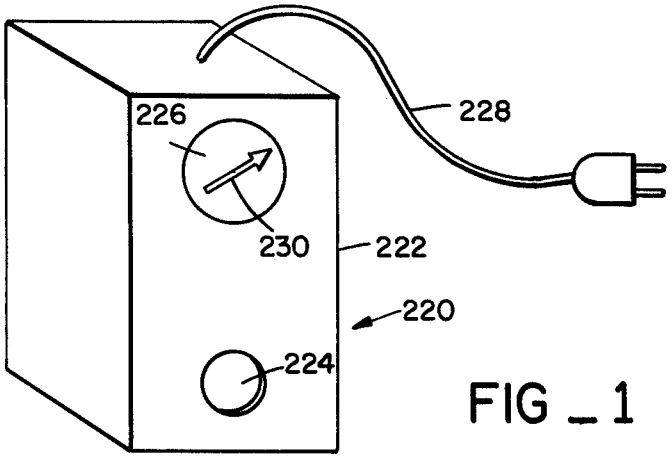
FIG. 1 is a view in perspective of another embodiment of the present invention providing a portable self-contained visual tuning-aid device for field alignment of electronic timepieces.
Figure 2:
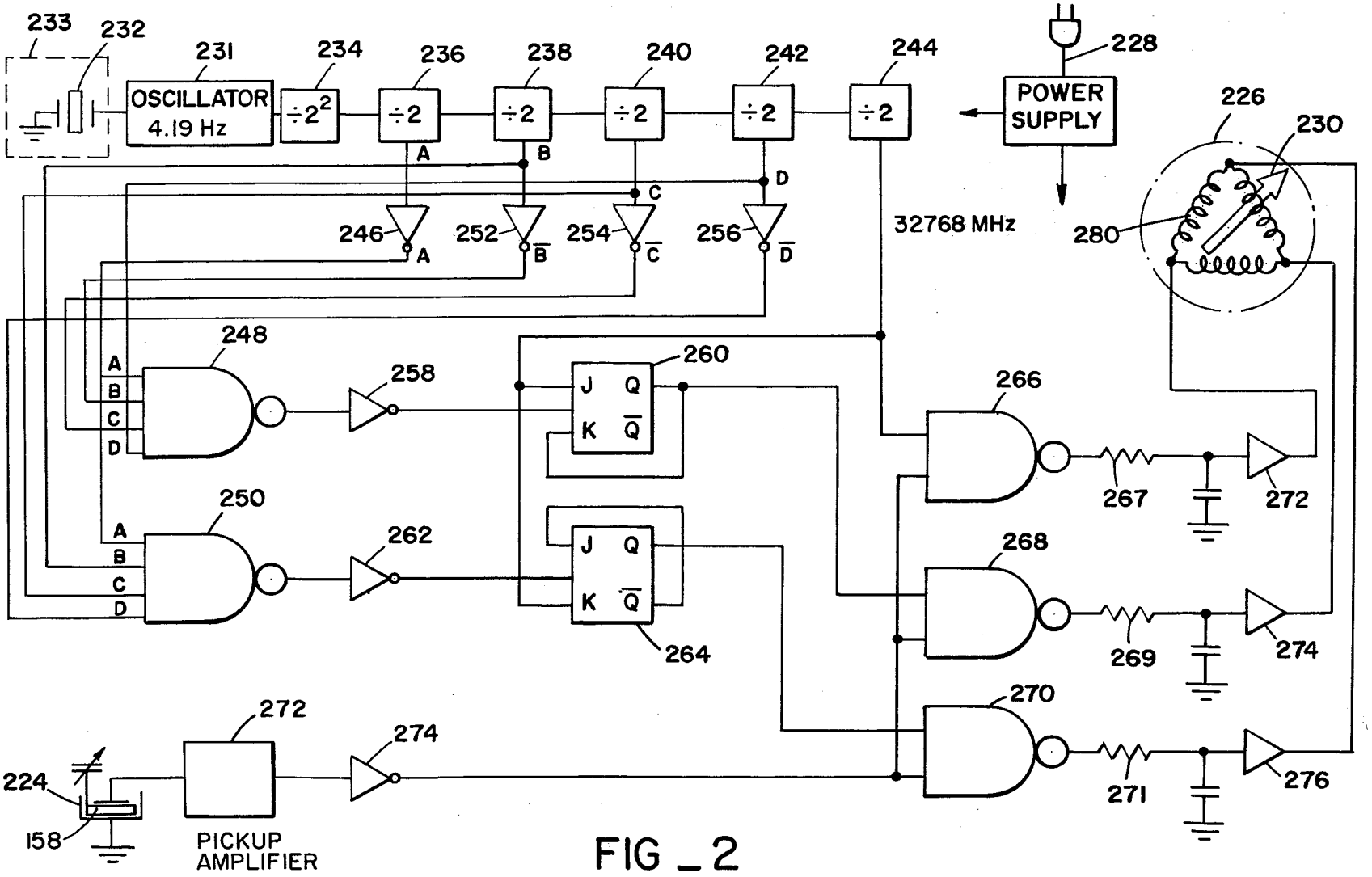
FIG. 2 is a detailed block and logic diagram of the device shown in FIG. 6 .

A preferred embodiment of the present invention is disclosed in FIGS. 1 and 2. A highly portable, self-contained frequency measuring station 220 includes a small box-like housing 222, a watch module sensor well 224, a three-phase motor driven display device 226 and a power cord 228 suitable for plugging into a standard electric current source. When line voltage is supplied to the unit 220, and an operating watch module 158 is placed in the watch module sensor well 224, an indicator needle 230 driven by the three-phase motor in the display 226 begins to rotate in one direction or the other, depending upon whether the watch module frequency is above or below a reference alignment frequency generated in the measuring station. Adjustment of the trimmer capacitor 160 in the watch module is made until the needle 230 stops rotating, thereby indicating that the frequency of the watch module 158 coincides with the frequency of the frequency measuring station 220.

The operation of the frequency measuring station 220 may be explained by reference to the block logic diagram of FIG. 2. A very stable 4.194304 megahertz oscillator 231 controlled by a temperature compensated A T cut crystal 232 provides a precise time base reference frequency. An oven 233 may be used to control the temperature of the quartz crystal 232.

The reference frequency is divided by a series of counters 234, 236, 238, 240, 242, and 244 to produce at a output of the counter 244 a 32,768hz signal which is the basic time base frequency generated in the watch module 158 and which may be adjusted by the trimmer 160.

The output of the counter 236 is a 524khz signal which is inverted by an inverter 246 to provide an input to two four input NAND gates 248 and 250. The signal from the inverter 246 is labeled $\overline{A}$. The output of the counter 238 is a signal at 262khz and that output, labeled B, provides an input to the NAND gate 248. An inverter 252 provides an inverted input signal to the NAND gate 250 labeled $\overline{B}$.

The counter 240 provides an output signal at 131khz labeled C which is provided at the input of the NAND gate 250. An inverter 254 is also connected at the output of counter 240 and the output, labeled C, of the inverter 254 provides an input to the NAND gate 248.

The output of the counter 242, labeled D, is a 65khz signal which is applied at a fourth input to the NAND gate 248. It is also inverted by an inverter 256 and applied as signal D to the fourth input of the NAND gate 250. The output of the NAND gate is applied through an inverter 258 to the clock input of a J-K flip flop 260. The output of the NAND gate 250 is inverted by an inverter 262 and then applied to the clock input of a J-K flip flop 264 similar to the flip flop 260. The J input of the flip flop 260 and the K input of the flip flop 264 are driven by the output signal of 32,768hz from the counter 244. The Q output of the flip flop 260 is returned to the K input of that flip flop; the Q output of the flip flop 264 is returned to the J input of that flip flop.

The 32,768hz output signal from the counter 244 is also applied to one input of a two input NAND gate 266. The Q output of the flip flop 260 is applied to one input of a two input NAND gate 268. And, the Q output of the flip flop 264 is applied to one input of a NAND gate 270. The leading edge of the pulse applied to the NAND gate 266 from the counter 244 is arbitrarily called $\phi$ 1 as it is the zero reference phase pulse. The signal applied to the input of the NAND gate 268 from the flip flop 260 lags $\phi$ 1 by approximately 120 ° and is labeled $\phi$ 2. The input signal to the NAND gate 270 from the flip flop 264 lags $\phi$ 1 by approximately 240 ° and is labeled $\phi$ 3. Thus the signals $\phi$ 1, $\phi$ 2 and $\phi$ 3 provide three phase waveforms.

A signal from a watch module 178 is detected in the sensor well 224 and is then amplified by an amplifier 272 which is described in connection with FIG. 3.

Figure 3:
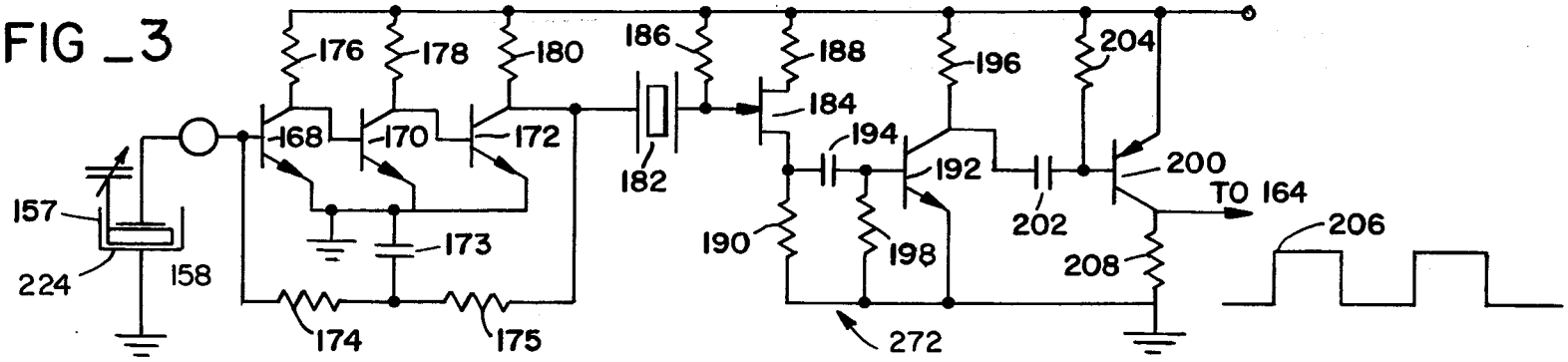
FIG. 3 is a schematic diagram of the pickup amplifier of FIG. 2.

Referring now to FIG. 3, the electrostatic sensor 224 may be provided with peripheral shielding 157 so that signals generated in the watch module 158 to be aligned are picked up while stray ambient signals are excluded. The sensed signals are fed through a very high gain amplifier section comprising transistors 168, 170 and 172. A large filter capacitor 173 inhibits feedback to provide very high gain; resistors 174 and 175 are selected to bias the transistors 168, 170 and 172 for class A operation; load resistors 176, 178 and 180 provide bias and impedance matching of the transistors 168, 170 and 172.

The output of the transistor 172 is passed through a narrow bandpass crystal filter 182 which establishes the bandpass characteristics of the entire unit. The crystal filter 182 is lightly loaded to the gate of a p-channel junction field effect transistor 184. High impedance at the gate is maintained by a bias resistor 186 of very high resistance on the order of 10 megohm. A source resistor 188 and a drain resistor 190 are provided to bias the field effect device 184 as a high gain class A amplifier.

The output of the transistor 184 is coupled through a blocking capacitor 194 to the base of a bipolar transistor 192, biased for class A operation by resistors 196 and 198. The collector of transistor 192 is connected to the base of a transistor 200 through a predetermined value capacitor 202 which operates in conjunction with a resistor 204 and the base impedance of the transistor 200 to provide a square wave output pulse 206. The output pulse 206 is provided at the collector of transistor 200 across a load resistor 208 and is then sent to the input of the inverter 274. The output of the sensor amplifier 272 is inverted by an inverter 274 and thence supplied as the second input to the NAND gates 266, 268, 270. These NAND gates function to combine the 32,768hz reference signal which has been divided into three phases and the signal at approximately the same frequency from the watch module 158 in the sensor well 224. The output signals at the NAND gates 266, 268 and 270 are series of pulses wherein the duration of each pulse varies in accordance with changing phase relationships between the watch module signal and the reference signal. Suitable integration networks 267, 269, and 271 at the outputs of the NAND gates 266, 268, 270 provide three phase waveforms which are proportional to the phase shift relationship. Suitable amplifiers 272, 274 and 276 may then be used to amplify the three phase signals to a suitable driving level and then the signals may be supplied to the field windings of 280 of a three phase motor display device 226. The armature of the device moves the rotating indicator 230 as shown in FIG. 6.

As is readily apparent, the integration of the phase shifting pulses at the delta windings 280 of the display device 226, cause the indicator needle 230 to rotate in one direction or another depending on the direction of phase shift. Adjustment of the tuning capacitor 180 in the module 158 to a point where the frequency of the module 158 coincides with the 32,768hz reference frequency at the output of counter 244 stops the phase shifting and eliminates the integrated waveform representing the phase shift. At this point, the needle 230 ceases to rotate, thereby indicating that the watch module has become aligned.

Thus, the frequency measuring station 220 provides a highly portable self-contained tuning aid for electronic watch modules operating at a predetermined time base frequency for use by jewelers and field technicians in serving and aligning the modules. The station runs on standard line voltage, is simple to operate and provides an accurate and unmistakable indication of alignment of the module.

To those skilled in the art to which this invention relates, many changes in construction and widely differing embodiments and applications of the invention will suggest themselves without departing from the spirit and scope of the invention. The disclosures and the description herein are purely illustrative and are not intended to be in any sense limiting.

I claim:

1. A visual timing aid system for aligning a time base signal generator in an electronic timepiece to a correct frequency including:

reference signal generator means for generating a reference signal at a frequency integrally related to said correct frequency;

sensor means for sensing and selectively amplifying a time base signal generated by the time base signal generator in a said electronic timepiece to be aligned;

phase change indicator means connected to said reference signal generator and to said sensor means for indicating by a relative movement the rate of phase change between said reference signal and said time base signal, said phase change indicator means including a multiphase motor having an armature element attached to a display indicator and a multiphase shifting network of the same number of phases as said motor and connected thereto and to said reference signal generator means and to said sensor means, for driving said motor with a drive signal proportional to the rate of change between said reference signal and said sensed time base signal;

whereby alignment of said time base signal generator to said correct frequency eliminates said phase change, and thereupon said display indicator ceases said relative movement indicating alignment of said time base signal generator to said correct frequency.

2. The tuning aid system of claim 1 further comprising amplifier means connected between said network and said motor for amplifying each phase of said drive signal.

3. The tuning aid system of claim 1 wherein said motor and said network are three phase.

* * * * *